US011311906B2

(12) United States Patent
Kusubashi et al.

(10) Patent No.: US 11,311,906 B2
(45) Date of Patent: Apr. 26, 2022

(54) CAN INNER SURFACE COATING METHOD

(71) Applicants: TMC JAPAN CO., LTD, Tokyo (JP); G&P Inc., Tokyo (JP)

(72) Inventors: Ryosuke Kusubashi, Tokyo (JP); Sho Ogiwara, Tokyo (JP); Naoyuki Yaguchi, Tokyo (JP)

(73) Assignees: TMC JAPAN CO., LTD., Tokyo (JP); G&P INC., Tokyo (JP)

( * ) Notice: Subject to any disclaimer, the term of this patent is extended or adjusted under 35 U.S.C. 154(b) by 103 days.

(21) Appl. No.: 16/651,535

(22) PCT Filed: Sep. 25, 2018

(86) PCT No.: PCT/JP2018/035499
§ 371 (c)(1),
(2) Date: Mar. 27, 2020

(87) PCT Pub. No.: WO2019/065648
PCT Pub. Date: Apr. 4, 2019

(65) Prior Publication Data

US 2020/0261941 A1 Aug. 20, 2020

(30) Foreign Application Priority Data

Sep. 28, 2017 (JP) ..... JP2017-189078

(51) Int. Cl.

| | |
|---|---|
| ***B05D 7/22*** | (2006.01) |
| ***B05D 1/02*** | (2006.01) |
| ***B05D 1/36*** | (2006.01) |
| ***B05D 3/02*** | (2006.01) |
| ***B05D 3/04*** | (2006.01) |
| ***B05D 1/00*** | (2006.01) |
| ***B05D 5/00*** | (2006.01) |

(52) U.S. Cl.
CPC ..... *B05D 7/227* (2013.01); *B05D 1/002* (2013.01); *B05D 1/02* (2013.01); *B05D 1/36* (2013.01); *B05D 3/0254* (2013.01); *B05D 3/046* (2013.01); *B05D 5/00* (2013.01); *B05D 2202/00* (2013.01); *B05D 2259/00* (2013.01); *B05D 2504/00* (2013.01); *B05D 2701/00* (2013.01)

(58) Field of Classification Search
None
See application file for complete search history.

(56) References Cited

U.S. PATENT DOCUMENTS 8,578,878 B2 * 11/2013 Khoury ..... B05B 13/0609 118/668

FOREIGN PATENT DOCUMENTS

| | | | |
|---|---|---|---|
| JP | 61-161182 | | 7/1986 |
| JP | 2-75363 | | 3/1990 |
| JP | 2-124983 | | 5/1990 |
| JP | 3-12262 | | 1/1991 |
| JP | H0312262 A | * | 1/1991 |
| JP | 2005-152891 | * | 6/2005 |
| JP | 2005-152891 A | | 6/2005 |
| JP | 2005-313924 | | 11/2005 |
| JP | 2006-159068 | | 6/2006 |
| JP | 2012-184370 | | 9/2012 |
| WO | 2007/133386 A2 | | 11/2007 |

OTHER PUBLICATIONS

Extended European Search Report dated Jun. 1, 2021 issued in European Application No. 18861639.5 (7 pages).
International Search Report for PCT/JP2018/035499 dated Jan. 8, 2019, 5 pages.
Written Opinion of the ISA for PCT/JP2018/035499 dated Jan. 8, 2019, 3 pages.
Search Report dated Dec. 17, 2021 issued in Chinese Application No. 2018800618570 with English translation (3 pages).
Machine Translation of JP 2005-152891 A (9 pages).

* cited by examiner

*Primary Examiner* — William P Fletcher, III
(74) *Attorney, Agent, or Firm* — Nixon & Vanderhye P.C.

(57) ABSTRACT

A coating method includes a first step for spraying, onto an inner area of an opening part of a cylindrical body having a bottom and arranged horizontally, a first coating material of synthetic resin containing non-volatile components while rotating the cylindrical body around a central axis thereof. After the first step, a second step is performed for spraying, onto an inner area of a barrel part of the cylindrical body, a second coating material of synthetic resin containing a lower proportion of non-volatile components than that of the first coating material while continuing to rotate the cylindrical body. After the second step is performed and before the volatile components of the second coating material vaporizes, a third step is performed in which the rotation of the cylindrical body is stopped, the cylindrical body is placed vertically, and the volatile components of the second coating material are vaporized.

4 Claims, 5 Drawing Sheets

Opening part coating step S1

Bottom part coating step S2

Barrel part coating step S3

CAN INNER SURFACE COATING METHOD

This application is the U.S. national phase of International Application No. PCT/JP2018/035499 filed Sep. 25, 2018 which designated the U.S. and claims priority to JP Patent Application No. 2017-189078 filed Sep. 28, 2017, the entire contents of each of which are hereby incorporated by reference.

TECHNICAL FIELD

The present invention relates to a can inner surface coating method for coating the inner surface of a bottomed cylindrical body that becomes a barrel of a can or a bottle can.

BACKGROUND ART

Conventionally, the inner surface of a can or a bottle can is coated with coating film of synthetic resin in order to prevent change of can's contents in taste, odor, and the like owing to contact of the contents such as a drinkable liquid of the can or the bottle can with metal that forms the can or the bottle can, and to prevent corrosion of the can or the bottle can.

The Patent Literature 1 discloses a can inner surface coating method, in which coating material is applied onto the inner surface of a bottomed cylindrical body that becomes a barrel of a bottle can so that coating film of synthetic resin is formed on the inner surface of the bottomed cylindrical body. This can inner surface coating method comprises: a first coating material applying step, in which a first coating material superior in machining resistance and corrosion resistance is applied onto an inner surface area of a bottomed cylindrical body's upper part (opening part) that becomes a mouth part of a bottle can; and a second coating material applying step, in which a second coating material superior in wettability or coating properties and in corrosion resistance is applied onto the inner surface area of at least the barrel part in a lower part that includes a bottom part of the bottomed cylindrical body.

According to the can inner surface coating method described in the Patent Literature 1, since the first coating material superior in machining resistance is applied onto the inner surface area of the upper part of the bottomed cylindrical body, which becomes the mouth part of the bottle can, it is possible to prevent occurrence of cracks, peeling, or the like in the coating film even when the upper part of the bottomed cylindrical body is so deformed that excessive load is applied to the coating film during a process of forming the mouth part. Further, since the second coating material superior in wettability or coating properties is applied onto the inner surface area of at least the barrel part in the bottomed cylindrical body, it is possible to form coating film that is thin and uniform in thickness on the inner surface area of at least the barrel part of the bottomed cylindrical body.

CITATION LIST

Patent Literature

Patent Literature 1: Japanese Unexamined Patent Application Laid-Open No. 2006-159068

SUMMARY OF INVENTION

Technical Problem

In the can inner surface coating method described in the Patent Literature 1, paint material is sprayed through the opening part of the bottomed cylindrical body toward the inner surface of the bottomed cylindrical body, while the bottomed cylindrical body, which is set in a horizontal position, is being rotated around the axis of the bottomed cylindrical body. Here, in order to form the coating film of thin and uniform thickness on the inner surface area of at least the barrel part in the lower part of the bottomed cylindrical body by using the second coating material superior in wettability or coating properties, it is required to keep rotating the bottomed cylindrical body around its own axis, until volatile components such as a solvent contained in the second coating material vaporize and is stabilized, after spraying the second coating material thinly and uniformly. Thus, devices required for this purpose increase the equipment cost.

The present invention has been made taking the above situation into consideration, and an object of the invention is to provide a can inner surface coating method that can form coating film on the whole area of the inner surface of a bottomed cylindrical body while strengthening the resistance to machining of the opening part of the bottomed cylindrical body, at low cost.

Solution to Problem

To solve the above problem, the method of the present invention comprises: an opening part coating step, in which a first coating material is sprayed onto an inner surface area of an opening part of a bottomed cylindrical body that becomes a barrel of a can or a bottle can, while the bottomed cylindrical body is put in a horizontal position and is being rotated around an central axis of the bottomed cylindrical body; a barrel part coating step, in which, after the opening part coating step, a second coating material is sprayed onto an inner surface area of a barrel part of the bottomed cylindrical body, while keeping the state of the bottomed cylindrical body in the horizontal position and in rotation around the central axis of the bottomed cylindrical body; and a vaporizing step, in which, after the barrel part coating step and before vaporization of volatile components of the second coating material sprayed onto the inner surface area of the barrel part of the bottomed cylindrical body, the rotation of the bottomed cylindrical body around its own central axis is stopped and the position of the bottomed cylindrical body is changed from the horizontal position to a vertical position, then the volatile components of the second coating material are made to vaporize.

Here, a synthetic resin that contains a larger amount of non-volatile components (for example, Non-Volatile Content of 24-35%) and is hardly-dripping is used as the first coating material. In addition, a synthetic resin that contains a smaller amount of non-volatile components (for example, Non-Volatile Content of 15-23%) than the first coating material and is easily-dripping is used as the second coating material. As the first and second coating materials, it is favorable to use coating materials of synthetic resins of the same kind.

Further, the present invention may comprise, in addition, a bottom part coating step, in which the second coating material is sprayed onto an inner surface of a bottom part of the bottomed cylindrical body, in advance of the vaporizing step. This bottom part coating step may be performed either before the barrel part coating step or after the barrel part coating step.

Advantageous Effects of Invention

In the present invention, after the barrel part coating step and before the vaporization of the volatile components of the second coating material sprayed onto the inner surface area of the barrel part of the bottomed cylindrical body, the rotation of the bottomed cylindrical body around its own central axis is stopped and the horizontal position of the bottomed cylindrical body is changed from the horizontal position to the vertical position. As a result, since the second coating material contains a smaller amount of non-volatile components than the first coating material and is easily-dripping, an excess of the second coating material drips from the inner surface area of the barrel part of the bottomed cylindrical body and moves to the inner surface area of the bottom part of the bottomed cylindrical body. Thereby, it is possible to form coating film having thin and uniform film thickness, and to extend the coating material also to the inner surface area of the bottom part of the bottomed cylindrical body, which has a complex shape difficult to be coated with coating material by spraying.

On the other hand, before the barrel coating step, since the inner surface area of the opening part of the bottomed cylindrical body is coated with the first coating material, which contains a larger amount of the non-volatile components than the second coating material and is hardly-dripping, the first coating material hardly drips even when the position of the bottomed cylindrical body is changed from the horizontal position to the vertical position in the vaporizing step. Accordingly, t is possible to form thicker coating film on the inner surface area of the opening part of the bottomed cylindrical body than on the inner surface area of the barrel part. As a result, it is possible to strengthen the machining resistance of the opening part of the bottomed cylindrical body.

Thus, according to the present invention, it is possible to form coating film on the whole area of the inner surface of the bottomed cylindrical body while strengthening the machining resistance of the opening part of the bottomed cylindrical body, at low cost.

DESCRIPTION OF EMBODIMENTS

Figure 1:
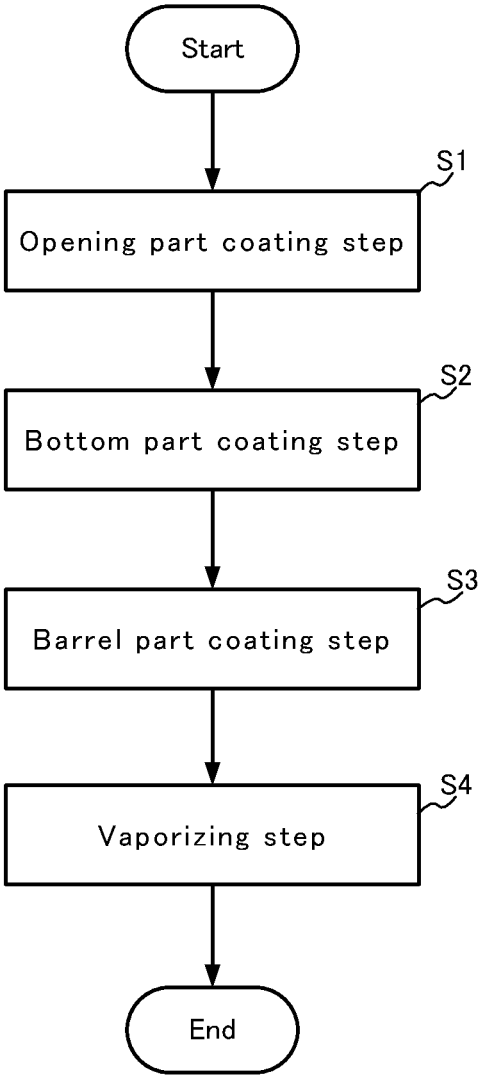
FIG. 1 is a flowchart for explaining a can inner surface coating method of one embodiment according to the present invention.

In the following, one embodiment of the present invention will be described referring to the drawings.

A can inner surface coating method of the present embodiment is a method for coating the inner surface of a bottomed cylindrical body that becomes a barrel of a can or a bottle can, and is implemented by a can inner surface coating apparatus that comprises a disk-shaped turret rotating intermittently by a predetermined angle each time and a plurality of spray devices for spraying coating material toward the inner surface of the bottomed cylindrical body. Here, the turret has a plurality of pockets that are arranged at regular intervals in the circumferential direction and hold each a bottomed cylindrical body in a horizontal position (horizontally) while rotating the bottomed cylindrical body around the central axis of the bottomed cylindrical body. Owing to the intermittent rotation of the turret, a bottomed cylindrical body held in each pocket is intermittently turned by the predetermined angle each time around the axis of rotation of the turret while being rotated around its own central axis. The plurality of spray devices are placed so as to correspond respectively to certain positions at which the pockets stop for a predetermined time owing to the intermittent rotation of the turret. Each spray device sprays coating material onto an assigned area of the inner surface of a bottomed cylindrical body that is held by a pocket and is in rotation around its own central axis, at the time when that pocket stops for the predetermined time at the position corresponding to the spray device concerned.

FIG. 1 is a flowchart for explaining the can inner surface coating method of the present embodiment.

[Opening Part Coating Step S1]

Figure 2:
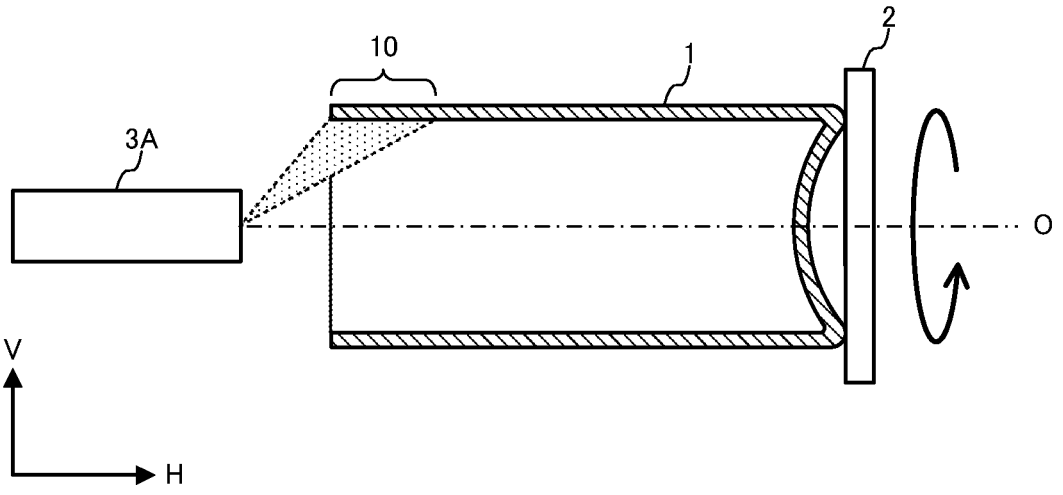
FIG. 2 is a view for explaining the opening part coating step S1 of FIG. 1.
Figure 3:
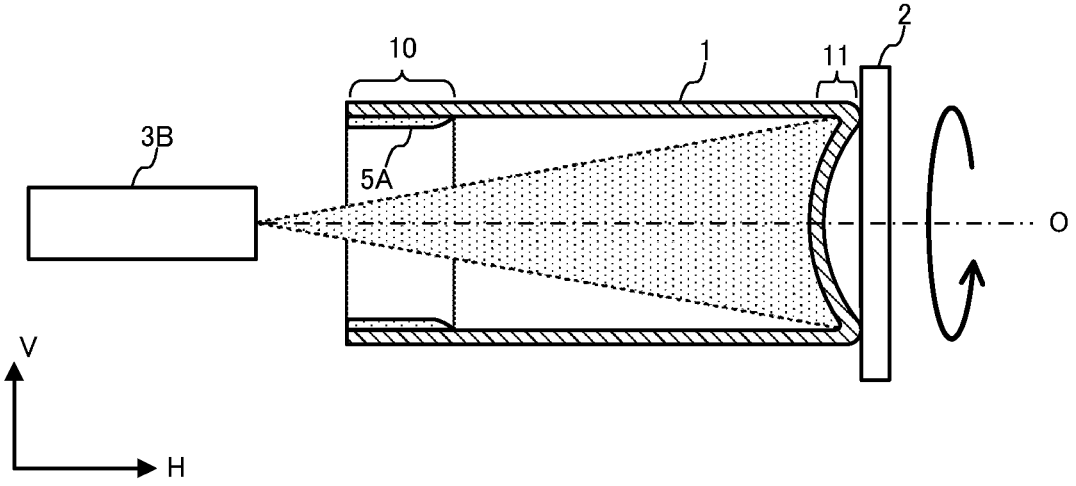
FIG. 3 is a view for explaining the bottom part coating step S2 of FIG. 1.
Figure 4:
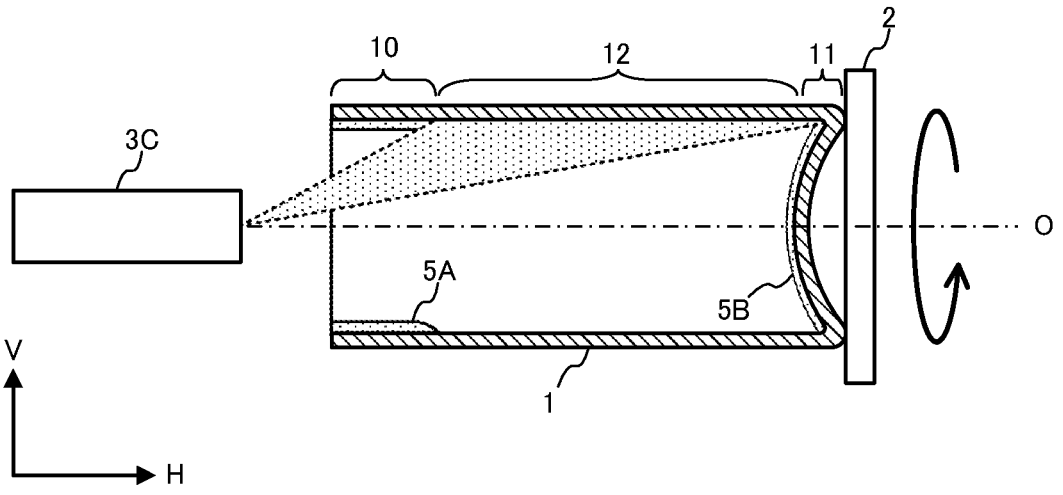
FIG. 4 is a view for explaining the barrel part coating step S3 of FIG. 1.

As shown in FIG. 2, when a bottomed cylindrical body 1, which is held by a pocket 2 in a horizontal position (in a state that its central axis O is in the horizontal direction H) while rotating around its own central axis O, moves to and stops at the position corresponding to an opening part spray device 3A owing to the intermittent rotation of the turret (not shown), the opening part spray device 3A sprays a first coating material onto an inner surface area of an opening part 10 of the bottomed cylindrical body 1 for a predetermined time. Then, owing to the rotation of the bottomed cylindrical body 1 around its own central axis O, the first coating material is applied onto the whole circumference of the inner surface area of the opening part 10 of the bottomed cylindrical body 1.

As the first coating material, is used synthetic resin that contains a larger amount of non-volatile components (for example, Non-Volatile Content of 24-35%) and is hardly-dripping, such as epoxy-acrylic type resin, epoxy-urea type resin, epoxy-phenolic type resin, or the like.

[Bottom Part Coating Step S2]

After the opening part coating step S1, the bottomed cylindrical body 1 moves to and stops at the position corresponding to a bottom part spray device 3B owing to the intermittent rotation of the turret while the bottomed cylindrical body 1 is kept in the horizontal position and in rotation around its own central axis O by the pocket 2. In turn, the bottom part spray device 3B sprays a second coating material onto an inner surface area of a bottom part 11 of the bottomed cylindrical body 1 for a predetermined time. Thereby, the second coating material is applied to the whole surface of the inner surface area of the bottom part 11 of the bottomed cylindrical body 1. Details of the second coating material will be described in the following description of a barrel part coating step S3.

[Barrel Part Coating Step S3]

After the bottom part coating step S2, the bottomed cylindrical body 1 moves to and stops at the position corresponding to a barrel part coating spray 3C owing to the intermittent rotation of the turret while the bottomed cylindrical body 1 is kept in the horizontal position and in rotation around its own central axis O by the pocket 2. In turn, the barrel part coating spray 3C sprays the second coating material for a predetermined time onto an inner surface area of a barrel part 12 of the bottomed cylindrical body 1 rotating around its own central axis O, so that the coated area partly overlaps the inner surface areas of the opening part 10 and the bottom part 11 of the bottomed cylindrical body 1. Owing to the rotation of the bottomed cylindrical body 1 around its own central axis O, the second coating material is applied onto the whole circumference of the inner surface area of the barrel part 12 of the bottomed cylindrical body 1.

As the second coating material, is used a coating material of synthetic resin that contains a smaller amount of non-volatile components (for example, Non-Volatile Content of 15-23%) than the first coating material and is easily-dripping, such as epoxy-acrylic type resin, epoxy-urea type resin, epoxy-phenolic type resin, or the like. Here, it is favorable that the second coating material is a coating material having high compatibility with the first coating material, such as a synthetic resin of the same kind as the first coating material. By using the second coating material having the high compatibility with the first coating material, it is possible to prevent peeling of the coating film of the second coating material from the coating film of the first coating material at the overlapping area of the first coating material applied onto the inner surface area of the opening part 10 of the bottomed cylindrical body 1 and the second coating material applied onto the inner surface area of the barrel part 12 of the bottomed cylindrical body 1.

[Vaporizing Step S4]

After the bottom part coating step S2, in a wet state before complete vaporizing of volatile components of the second coating material sprayed onto the inner surface area of the barrel part 12 of the bottomed cylindrical body 1, the bottomed cylindrical body 1 is taken out from the pocket 2 and the rotation of the bottomed cylindrical body 1 around its own central axis O is stopped, then the horizontal position of the bottomed cylindrical body 1 is changed to a vertical position (a state that its central axis O is in the vertical direction V). For example, in the case where the second coating material is an epoxy type resin having Non-Volatile Content of 20%, it is favorable that the rotation of the bottomed cylindrical body 1 around its own central axis O is stopped and the horizontal position of the bottomed cylindrical body 1 is changed to the vertical position, within 5 seconds from the end of the bottom part coating step S2. Then, the bottomed cylindrical body 1 is left as it is for a predetermined time, so as to vaporize the volatile components of the second coating material. The vaporizing step S4 may be performed in the can inner surface coating apparatus or in a conveyor installed on the downstream side of the can inner surface coating apparatus.

Hereinabove, one embodiment of the present invention has been described.

Figure 5:
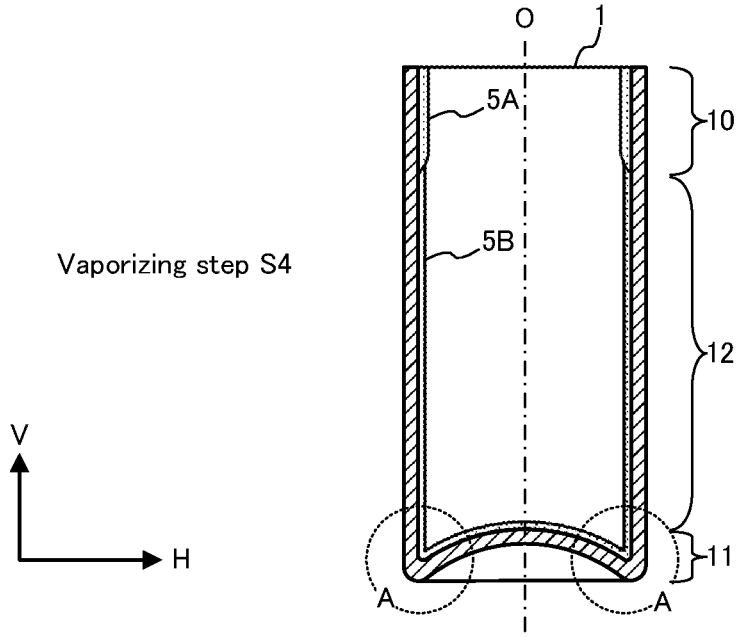
FIG. 5 is a view for explaining the vaporizing step S4 of FIG. 1.

In the present embodiment, after the barrel part coating step S3, in a wet state before complete vaporization of the volatile components of the second coating material sprayed onto the inner surface area of the barrel part 12 of the bottomed cylindrical body 1, the rotation of the bottomed cylindrical body 1 around its own central axis O is stopped and the bottomed cylindrical body 1 is changed from the horizontal position to the vertical position. Accordingly, since the second coating material contains a smaller amount of non-volatile components than the first coating material and is easily-dripping, an excess of the second coating material drips from the inner surface area of the barrel part 12 of the bottomed cylindrical body 1 and moves to the inner surface area of the bottom part 11 of the bottomed cylindrical body 1. As a result, it is possible to form coating film 5B that is thin and uniform in film thickness on the inner surface area of the barrel part 12 of the bottomed cylindrical body 1 without keeping the bottomed cylindrical body 1 rotating around its central axis O. It is possible to extend the coating material also to the inner surface area of the bottom part 11 of the bottomed cylindrical body 1, which has a complex shape (for example, the part A in FIG. 5) difficult to be coated with coating material by spraying.

On the other hand, before the barrel coating step S3, the inner surface area of the opening part 10 of the bottomed cylindrical body 1 is coated with the first coating material, which contains a larger amount of non-volatile components than the second coating material and is hardly-dripping. Thereby, even when the position of the bottomed cylindrical body 1 is changed from the horizontal position to the vertical position in the vaporizing step S4, the first coating material hardly drips. Accordingly, it is possible to form thicker coating film 5A on the inner surface area of the opening part 10 of the bottomed cylindrical body 1 than on the inner surface area of the barrel part 12 (See FIG. 5). As a result, it is possible to strengthen the machining resistance of the opening part 10 of the bottomed cylindrical body 1.

Thus, according to the present embodiment, it is possible to form the coating film on the whole inner surface of the bottomed cylindrical body 1 while strengthening the machining resistance of the opening part 10 of the bottomed cylindrical body 1, at low cost.

Further, in the present embodiment, by using as the second coating material a coating material having the high compatibility with the first coating material, for example a synthetic resin of the same kind as the first coating material, it is possible to prevent peeling of the coating film of the second coating material from the coating film of the first coating material at the overlapping area of the first coating material applied to the inner surface area of the opening part 10 of the bottomed cylindrical body 1 and the second coating material applied to the inner surface area of the barrel part 12 of the bottomed cylindrical body 1. Accordingly, it is possible to prevent that the content of a can or a bottle can, which is produced by processing the opening part 10 of the bottomed cylindrical body 1, intrudes the peeled part and comes in contact with the metal that forms the can or the bottle can.

The present invention is not limited to the above embodiment, and can be varied variously within the scope of the invention.

For example, although in the above embodiment the bottom part coating step S2 is performed after the opening part coating step S1 and before the barrel part coating step S3, the present invention is not limited to this. It is sufficient that the bottom coating step S2 is performed in advance of the vaporizing step S4. Thus, the bottom coating step S2 may be performed after the barrel coating step S3 or before the opening part coating step S1, as far as the bottom coating step S2 is performed in advance of the vaporizing step S4.

Further, in the above embodiment, after the barrel part coating step S3 and in advance of the vaporizing step S4, an inspection step for inspecting the coating state of the inner surface of the bottomed cylindrical body 1 and the external appearance of the bottomed cylindrical body 1 may be performed. In this case, it is on the premise that the vaporizing step S4 is performed in a wet state before the second coating material, which has been sprayed onto the inner surface area of the barrel part 12 of the bottomed cylindrical body 1, complete vaporizes.

REFERENCE SIGNS LIST

1: bottomed cylindrical body; 2: pocket; 3A-3C: spray device; 5A, 5B: coating film; 10: opening part of the bottomed cylindrical body 1; 11: bottom part of the bottomed cylindrical body 1; and 12: barrel part of the bottomed cylindrical body 1.

The invention claimed is:

1. A can inner surface coating method for coating an inner surface of a bottomed cylindrical body that becomes a barrel of a can or a bottle can, comprising:

an opening part coating step, in which a first coating material is sprayed onto an inner surface area of an opening part of the bottomed cylindrical body, while the bottomed cylindrical body is in a horizontal position and being rotated around an central axis of the bottomed cylindrical body;

a barrel part coating step, in which, after the opening part coating step, a second coating material is sprayed onto an inner surface area of a barrel part of the bottomed cylindrical body, while keeping the bottomed cylindrical body in the horizontal position and in the state of being rotated around the central axis of the bottomed cylindrical body; and a vaporizing step, in which, after the barrel part coating step and before vaporization of volatile components of the second coating material sprayed onto the inner surface area of the barrel part of the bottomed cylindrical body, the rotation of the bottomed cylindrical body around the central axis is stopped and the position of the bottomed cylindrical body is changed from the horizontal position to a vertical position, then the volatile components of the second coating material are made to vaporize, wherein, the first coating material is a coating material of synthetic resin that contains a larger amount of non-volatile components than the second coating material.

2. A can inner surface coating method of claim 1, wherein:

the first coating material and the second coating material are coating materials of synthetic resins that are compositionally the same type.

3. A can inner surface coating method of claim 2, further comprising:

a bottom part coating step, in which the second coating material is sprayed onto an inner surface area of a bottom part of the bottomed cylindrical body, in advance of the vaporizing step.

4. A can inner surface coating method of claim 1, further comprising:

a bottom part coating step, in which the second coating material is sprayed onto an inner surface area of a bottom part of the bottomed cylindrical body, in advance of the vaporizing step.

* * * * *